US005310173A

United States Patent [19]

Martinez

[11] Patent Number: 5,310,173

[45] Date of Patent: May 10, 1994

[54] BILL VALIDATOR WITH BILL TRANSPORT SYSTEM

[75] Inventor: Alejandro R. Martinez, St. Louis, Mo.

[73] Assignee: Coin Acceptors, Inc., St. Louis, Mo.

[21] Appl. No.: 50,817

[22] Filed: Apr. 21, 1993

[51] Int. Cl.[5] ..... B65H 29/16

[52] U.S. Cl. ..... 271/198; 198/813

[58] Field of Search ..... 271/198, 275, 181; 198/813, 814, 815

[56] References Cited

U.S. PATENT DOCUMENTS

| | | | |
|---|---|---|---|
| 4,603,847 | 8/1986 | Oota | 271/162 X |
| 4,732,375 | 3/1988 | Tetherton | 271/188 X |
| 4,765,607 | 8/1988 | Zouzoulas | 198/814 X |

*Primary Examiner*—Richard A. Schacher
*Attorney, Agent, or Firm*—Cohn, Powell & Hind

[57] ABSTRACT

This bill validator (10) includes a bill transport system (20) for conveying bills (B) to a location adjacent a bill collection compartment (12). The transport system (20) comprises a first pair of spaced belt assemblies (70) including a lower pulley (80) an upper pulley (82) and a belt (86) movable between said pulleys; a second pair of spaced belt assemblies (72) including a lower pulley (90) an upper pulley (92) and a belt (94) movable between said pulleys, associated belts (86, 94) being adjacent to direct bills (B) in a generally vertical path, the belts (86, 94) being moved into engagement by providing the lower pulleys (90) of the second belt assemblies (72) with a floating journal (104) and by providing the associated belts (94) with a length to induce tension into said belts (94) and apply a force to said pulleys (80) to provide sufficient pressure between said belts (86, 94) to grip and convey said bills (B).

10 Claims, 1 Drawing Sheet

BILL VALIDATOR WITH BILL TRANSPORT SYSTEM

BACKGROUND OF THE INVENTION

This invention relates generally to bill validators for vending machines or the like and particularly to a bill validator having an improved transport system for conveying the bills to a bill collection compartment.

In general, bill validator transport systems of the type under consideration, which convey bills from a receiving slot to a location adjacent a collection compartment by gripping the edges of the bill, so that it can then be pushed into a collection compartment, are of two types. In the first type of transport system, represented by U.S. Pat. No. 4,887,808, the bill edges are sandwiched between spaced pairs of engageable belts, one pair of spaced belts being idler belts. This system suffers from the disadvantage that the gripping ability of the paired belts which engage the edges of the bill must be carefully controlled since insufficient pressure results in bill slippage while too much pressure results in the problem of pushing the bill into the collection compartment. In the second type of transport system, represented by U.S. Pat. No. 4,678,072, the bill edges are sandwiched between spaced pairs of belts and spaced sets of spring-biased rollers. While this system offers some tension control between the gripped edges of the bill it lacks the continuity of gripping which is available along the full length of the bill where double belts are used and, in addition, the spring-biased rollers require careful mounting and adjusting to ensure correct bias and add additional mechanical parts.

The present bill transport system is an improvement of the first type of transport system and overcomes the problems discussed above in a manner not disclosed in the known prior art.

SUMMARY OF THE INVENTION

This improved transport system for a bill validator utilizes a self-adjusting transport system which provides a positive drive between two spaced pairs of belts to grip the edges of the bill and convey the bill to the required location. The pressure, or pinch force, between the conveying belts is created by providing an idler belt assembly having a floating pulley arrangement and a tensioned belt which is automatically urged into engagement with the engaged belt of a drive belt assembly.

The advantages of the system are that there is a reduction in the number of parts required and the construction and assembly are simplified; the system automatically adjusts to dimensional deviations and, to some extent, to the mismatch of parts and automatically accommodates wear in the belts and moving parts.

This bill transport system includes a first pair of spaced belt means each including a lower pulley, an upper pulley and an endless belt movable between said lower and upper pulley, a second pair of spaced belt means, each including a lower pulley, an upper pulley and an endless belt movable between said lower and upper pulley, said belt being disposed adjacent an associated belt of said first belt means to receive and direct bills in a generally vertical path, and means moving said associated belts of said belt means into engagement, said moving means including floating journal means for one pair of pulleys of one pair of belt means, the associated endless belts having a length selected to induce tension into said belts and apply a force to said pulleys having said floating journal means to provide sufficient pressure between said belts to grip and convey said bills.

It is an aspect of this invention to provide that the first pair of belt means are drive belt means and the second pair of belt means are idler belt means.

It is another aspect of this invention to provide that the floating journal means includes opposed sidewalls having slots and the associated pulleys include shafts received in said slots in movable relation.

It is yet another aspect of this invention to provide that the floating journal means are provided for the lower pulleys of the second pair of belt means.

It is still another aspect of this invention to provide that the slots are inclined upwardly in a direction toward the first pair of belt means.

This transport system is simple in construction, relatively inexpensive to manufacture and operates effectively for its intended purpose.

DESCRIPTION OF THE PREFERRED EMBODIMENT

Figure 1:
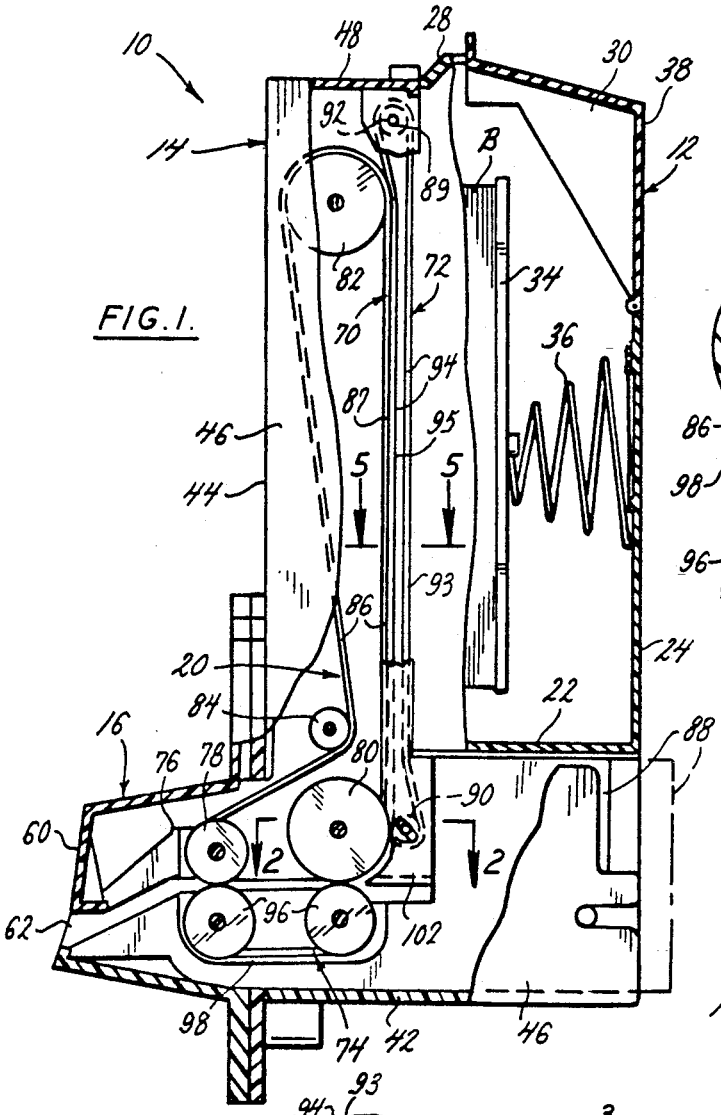
FIG. 1 is an elevational view of the bill validator partly in cross-section.
Figure 3:
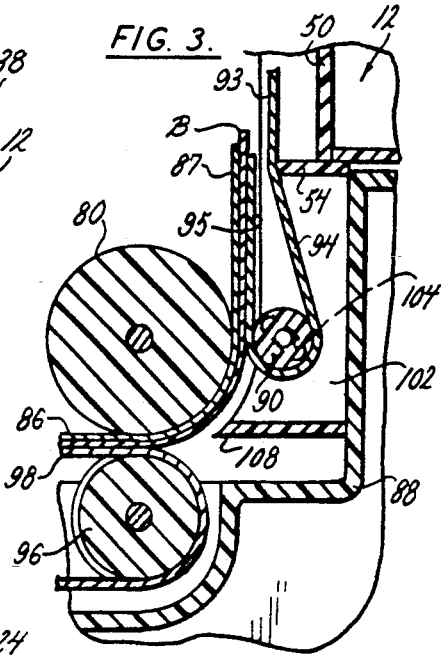
FIG. 3 is a fragmentary cross-sectional view taken on line 3—3 of FIG. 2.

Referring now by reference numerals to the drawing and first to FIG. it will be understood that the bill validator 10 includes a first housing 12, providing a bill collection compartment, a second generally ell-shaped housing 14, to which the first housing is removably attached, and a third housing 16, which is removably attached to the second housing 14 and cooperates with the second housing to house a bill transport system 20.

Figure 5:
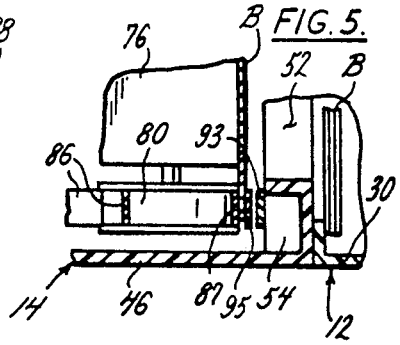
FIG. 5 is a fragmentary cross-sectional view taken on line 5—5 of FIG. 1.
Figure 4:
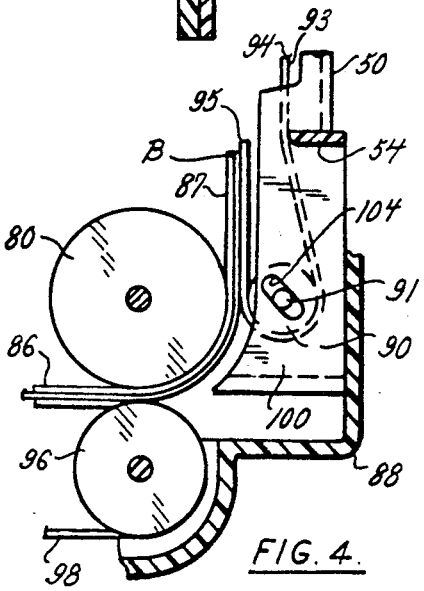
FIG. 4 is a fragmentary cross-sectional view taken on line 4—4 of FIG. 2.

The first housing 12 includes a lower wall 22, a rear wall 24, sidewalls 26 an upper wall 28 and side members 30. The housing 12 includes a bill compressor plate 34, which is held in place by a compression spring 36, so that bills B are sandwiched between the compression plate 34 and the side members 30, as shown in FIG. 5. A hinged access door 38 is provided at the upper right corner of the housing 12 to afford easy access to the collected bills B.

The ell-shaped second housing 14 includes a lower wall 42, a front wall 44, sidewalls 46, an upper wall 48, and re-entrantly formed side members 50, defining an access opening 52, which are abutted by the side members 30 of the first housing 12. A cross member 54 is provided between the side members 50.

The third housing 16 includes a front wall 60, which defines a bill-receiving slot 62 and said third housing 16 is attached to the second housing 14.

Figure 2:
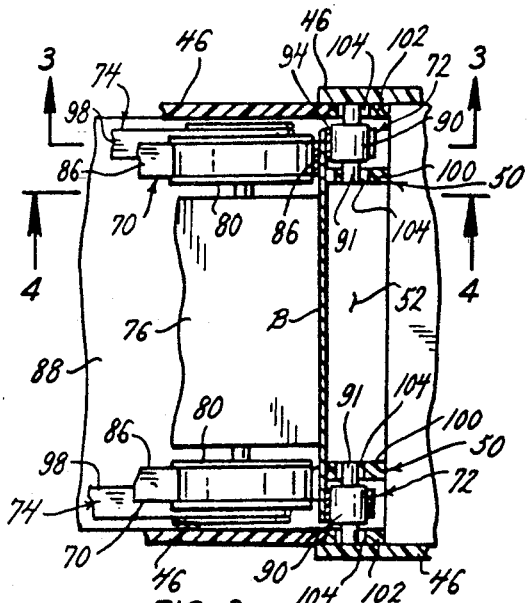
FIG. 2 is a cross-sectional view taken on line 2—2 of FIG. 1.

The bill transport system 20 includes three sets of spaced pairs of belt assemblies 70, 72 and 74. As shown in FIGS. 2 and 5 the first belt assemblies 70 are mounted to an interior support 76 and are disposed at each side of the access opening 52, each assembly 70 including lower pulleys 78 and 80, upper pulley 82, intermediate pulley 84, and an endless belt 86. The second belt assemblies 72 are mounted between the sidewalls of the reentrantly formed side members 50 of the housing 14 and are also disposed on each side of the access opening 52, each assembly 72 including a lower pulley 90, an upper pulley 92 and an endless belt 94. The third belt assemblies 74 are mounted to a removable support 88, below the first belt assemblies 70, each assembly 74 including a pair of pulleys 96 and an endless belt 98. In the embodiment shown, belt assemblies 70 are drive assemblies and belt assemblies 72 and 74 are driven, or idler, assemblies.

More specifically, the first belt assembly lower pulleys 78 and 80 and upper pulley 82 are mounted for rotation about fixed axes and each endless belt 86 includes a front flight 87 travelling in a substantially vertical path and constituting a first flight. The second belt assembly upper pulleys 92 are also mounted for rotation about fixed axes between the opposed sidewalls 100 and 102 of side members 50. The lower pulleys 90, however, are mounted for floating movement by providing journal mountings in the form of inclined slots 104 in each of the sidewalls 100 and 102, which permit the pulley shafts 91 to ride or float in said slots. Each endless belt 94 includes a rear flight 95 travelling in a substantially vertical path for the greater part of its length and constituting a first flight. Each belt 94 is of a selected overall length such that, when the lower pulley 90 is centered in its slot 104, said belt is under tension tending to urge each pulley shaft 91 upwardly and inwardly in its slot 104 thereby urging each rear flight 95 into engagement with its associated front flight 87. Each upper pulley 92 has its shaft 89 mounted inwardly, out of vertical alignment with the center of the inclined slot 104, so that each rear flight 95 is urged into engagement with its associated front flight 87 in the vicinity of the associated upper pulley 82. The rear flight 93 of each second belt assembly 72 is guided at its lower end by engagement with the cross member 54 between the sidewalls of side members 50. The lower end of each of the side members 50 includes a cross member 108 which directs the bill B, by virtue of the curved lower ends of sidewalls 100, into sandwiched relationship between the engageable flights 87 and 95 of the first and second belt assemblies 70 and 72, respectively, as they emerge from the sandwiched relationship between the belts 86 and 98 of the first and third belt assemblies 70 and 74.

The arrangement of belt assemblies described above provides that a bill B, which is inserted into the receiving slot 62 of the third housing 16, is gripped on each side initially by associated spaced pairs of endless belts 86 and 98, and transported from a horizontal to a vertical path by associated side members 50 to be received in sandwich relation between front and rear flights 87 and 95, respectively, of said spaced pairs of endless belts 86 and 94 for vertical transportation to a selected elevation from which the bill B can be pushed by pusher (not shown), into the collection compartment 12.

Having described the invention in detail, those skilled in the art will appreciate that modifications may be made without departing from the spirit thereof. Therefore, it is not intended that the scope of the invention be limited to the specific embodiments illustrated and described. Rather, it is intended that the scope of this invention be determined by the appended claims and their equivalents.

I claim as my invention:

1. A bill validator having a bill transport system for conveying bills to a location adjacent a bill collection compartment, the bill transport system comprising:

(a) a first pair of spaced belt means each including a lower pulley, an upper pulley and an endless belt movable between said lower and upper pulley, (b) a second pair of spaced belt means, each including a lower pulley, an upper pulley and an endless belt movable between said lower and upper pulley, said belt being disposed adjacent an associated belt of said first belt means to receive and direct bills in a generally vertical path, and (c) means moving said associated belts of said belt means into engagement, said moving means including floating journal means for one pair of pulleys of one pair of belt means, the associated endless belts having a length selected to induce internal tension into said belts and apply a force to said pulleys having said floating journal means to provide sufficient pressure between said belts to grip and convey said bills.

2. A bill transport system as defined in claim 1, in which (d) The first pair of belt means are drive belt means and the second pair of belt means are idler belt means.

3. A bill transport system as defined in claim 1, in which:

(d) the floating journal means includes opposed sidewalls having slots and the associated pulleys include shafts received in said slots in movable relation.

4. A bill transport system as defined in claim 1, in which:

(d) the first pair of belt means are drive belt means and the second pair of belt means are driven belt means, (e) the floating journal means are provided for the lower pulleys of the second pair of belt means and include opposed sidewalls having slots, said lower pulleys including shafts received in said slots in movable relation.

5. A bill validator having a bill transport system for conveying bills to a location adjacent a bill collection compartment, the bill transport system comprising:

(a) a first pair of spaced belt means each including a lower pulley, an upper pulley and an endless belt movable between said lower and upper pulley, (b) a second pair of spaced belt means, each including a lower pulley, an upper pulley and an endless belt movable between said lower and upper pulley, said belt being disposed adjacent an associated belt of said first belt means to receive and direct bills in a generally vertical path, and (c) means moving said associated belts of said belt means into engagement, said moving means including floating journal means for one pair of pulleys of one pair of belt means, the associated endless belts having a length selected to in due tension into said belts and apply a force to said pulleys having said floating journal means to provide sufficient pressure between said belts to grip and convey said bills, (d) the floating journal means including slots, the slots being inclined upwardly in a direction toward the first pair of belt means.

6. A bill validator having a bill transport system for conveying bills to a location adjacent a bill collection compartment, comprising:

(a) a housing for the bill transport system including side members defining an access opening, (b) a first pair of spaced belt means disposed on each side of the access opening, each including a lower pulley, an upper pulley and an endless belt movable between said upper and lower pulley, (c) a second pair of spaced belt means each including a lower pulley, mounted to associated side members, an upper pulley mounted to said side members and an endless belt movable between said lower and upper pulley, said belt being disposed adjacent an associated belt of said first belt means to receive and direct bills in a generally vertical path, (d) said side members mounting said lower pulley of each of said second belt means including opposed sidewalls having slots upwardly inclined toward said first belt means and said associated lower pulley including a shaft received in said slots, and the associated endless belts having a length selected to induce tension into said belts and apply a force tending to move said lower pulleys upwardly in said slots to urge associated belts of said first and second belt means into engagement provide sufficient pressure between said belts to grip and convey said bills.

7. A bill validator as defined in claim 6, in which:

(e) said housing side members are re-entrantly formed to provide said opposed sidewalls.

8. A bill validator as defined in claim 6, in which:

(e) said lower pulley of each of said first pair of spaced belt means is an inner pulley and said first pair of spaced belt means each includes an outer pulley and said endless belt of each pair of spaced belt means includes a generally horizontal flight, (f) a third pair of spaced belt means is provided below each of said first pair of spaced belt means each including an endless belt having a generally horizontal flight disposed adjacent an associated horizontal flight of said first pair of spaced belt means, to receive and direct said bills in a generally horizontal path, and (g) arcuate guide members are provided to guide said bills from said generally horizontal to said generally vertical path.

9. A bill validator as defined in claim 6, in which:

(e) said first pair of spaced belt means each include first and second flights, and (f) transverse members are provided disposed above said lower pulleys of each of said first belt means and engageable by said associated second flights to move said second flights toward said first flights.

10. A bill validator as defined in claim 6, in which:

(e) said first pair of spaced belt means each include first flights and said second pair of spaced belt means each include first flights and (f) said upper pulleys of said second pair of spaced belt means are disposed above said upper pulleys of said first pair of spaced belt means and are located such that said first flight of said second pair of spaced belt means exerts a pressure on said associated first flight of said first pair of belt means in the vicinity of said associated upper pulley of said first belt means.

* * * * *